United States Patent [19]

Sinner et al.

[11] Patent Number: 4,742,814

[45] Date of Patent: May 10, 1988

[54] PROCESS FOR PRODUCTION OF XYLITOL FROM LIGNOCELLULOSIC RAW MATERIALS

[75] Inventors: Michael Sinner, Dassendorf; Hans-Hermann Dietrichs, Reinbek; Jürgen Puls, Pinneberg; Werner Schweers, Reinbek; Karl-Heinz Brachthäuser, Ratingen, all of Fed. Rep. of Germany

[73] Assignee: Bau- und Forschungsgesellschaft Thermoform AG, Murten/Fribourg, Switzerland

[21] Appl. No.: 9,569

[22] Filed: Jan. 30, 1987

Related U.S. Application Data

[60] Continuation of Ser. No. 716,650, Mar. 27, 1985, abandoned, which is a division of Ser. No. 521,657, Aug. 10, 1983, Pat. No. 4,520,105, which is a continuation of Ser. No. 257,256, Apr. 24, 1981, abandoned, which is a continuation of Ser. No. 116,207, Jan. 28, 1980, abandoned, which is a continuation of Ser. No. 933,623, Aug. 14, 1978, abandoned.

[30] Foreign Application Priority Data

Aug. 17, 1977 [DE] Fed. Rep. of Germany ..... 2737118

[51] Int. Cl.[4] ..... D21C 3/20; C13K 1/02; C13K 13/00

[52] U.S. Cl. ..... 127/37; 162/19; 162/72; 162/77; 162/76

[58] Field of Search ..... 435/161, 163; 127/37; 162/17, 18, 19, 72, 77, 76

[56] References Cited

U.S. PATENT DOCUMENTS

| | | | |
|---|---|---|---|
| 4,018,620 | 4/1977 | Penque | 127/37 |
| 4,237,226 | 12/1980 | Grethlein | 127/37 |
| 4,470,851 | 9/1984 | Pasner et al. | 162/14 |

*Primary Examiner*—Steve Alvo

*Attorney, Agent, or Firm*—Foley & Lardner, Schwartz, Jeffery, Schwaab, Mack, Blumenthal & Evans

[57] ABSTRACT

A process for the production of sugars, and optionally cellulose and lignin, from lignocellulosic vegetable materials which comprises subjecting the vegetable materials to a chemical pretreatment with a mixture of water and lower aliphatic alcohols and/or ketones at a temperature from 100° to 190° C. for a period of from 4 hours to 2 minutes with control of the breakdown of the hemicellulose components followed by separation of residue and a subsequent main chemical treatment with a similar solvent mixture at elevated temperatures for a further period of from 6 hours to 2 minutes.

11 Claims, 5 Drawing Sheets

SUGARS IN HYDROLYSATES OF CELLULOSES

FIBROUS MATERIAL BIRCH 4b (TABLE 1)

0.020N HYDROCHLORIC ACID / ACETONE / WATER 13 MIN, 200°C (TAB. 5)

FIBROUS MATERIAL OAK (TABLE 3)

0.025N HYDROCHLORIC ACID / ACETONE / WATER 7 MIN, 200°C (TAB. 5, 1st CHEM. TREATMENT)

FIBROUS MATERIAL SPRUCE (ETHANOL / WATER

20 MIN 170°C, TAB. 2/ 0.025N HYDROCHLORIC ACID / ETHANOL / WATER 15 MIN, 200°C) 0.025N HYDROCHLORIC ACID / ACETONE / WATER 20 MIN. 200°C (TAB. 5)

SUGARS IN THE HYDROLYSED AQUEOUS PHASES OF THE SPRUCE-WOOD CHEMICAL TREATMENT SOLUTION

ETHANOL / WATER
20 MIN.
170°C (TAB. 2)

0.05N OXALIC ACID/ACETONE
WATER 10 MIN.
200°C (TAB. 3)

FURFUROLS IN AQUEOUS PHASE OF THE TREATMENT FIBROUS MATERIAL, BIRCH, (ACETONE / WATER, 30 MIN. 160°C; 40 MIN. 200°C), 0.025N HYDROCHLORIC ACID/ACETONE/ WATER, 20 MIN. 200°C, (TAB. 7, B)

PROCESS FOR PRODUCTION OF XYLITOL FROM LIGNOCELLULOSIC RAW MATERIALS

This application is a continuation of application Ser. No. 716,650, filed Mar. 27, 1985 and now abandoned, which in turn was a division of co-pending application Ser. No. 521,657, filed Aug. 10, 1983, now U.S. Pat. No. 4,520,105. Said co-pending application is a continuation of application Ser. No. 257,256 filed Apr. 24, 1981, which in turn was a continuation of application Ser. No. 116,207 filed Jan. 28, 1980, which in turn was a continuation of application Ser. No. 933,623 filed Aug. 14, 1978, each of which is now abandoned.

The invention relates to a process for the production of sugars and, optionally, cellulose and/or lignin from lignocellulosic vegetable raw materials by treatment with solvent mixtures at elevated temperatures and pressures.

The chemical treatment of cellulose-containing raw materials, such as wood, in order to obtain products contained therein is known. Various chemical treatments have been applied depending on the particular type of products desired. Many processes of chemical treatment have been described under the influence of which loosening of the cell-wall binding and detachment of mastic substances is effected so that the fibrous structure of the cellulose can be exposed by defibration, the cellulose thus provided finding application in this form as a raw material in, for example, panels and paper, etc. According to the particular conditions of chemical treatment chosen, the substances associated with the cellulose can be removed to such an extent that pure cellulose for further processing, for example to rayon and staple fibre, etc. is provided. The separated substances accumulate in dissolved form and are usually destroyed.

Treatment of vegetable raw materials with a mixture of water and lower aliphatic alcohols and/or of lower aliphatic ketones at temperatures of between about 150° C. and about 200° C., at high pressure with separation of the fibrous materials from the treatment solution is also known. The organic solvents can be removed from the treatment solution and recovered. In this case a residue is obtained which separates into two phases.

The heavier phase essentially consists of a thermoplastic composition of lignin whereas the supernatant aqueous phase contains the water-soluble components of the treatment mixture, essentially a mixture of monomeric sugars, oligosaccharides and organic acids, etc. (See United States Pat. No. 3 585 104). This mixture of monomeric sugars, oligosaccharides, etc. can, according to the state of the art, be subjected to hydrolysis to split the oligosaccharides to monomeric sugars.

This known process has the disadvantage that it is difficult to separate the lignin. As a rule, it accumulates in the form of an oily mass, which becomes more viscous at low temperatures and which consequently is difficult to remove from the equipment. This lignin also contains many impurities. It also contains a considerable proportion of carbohydrates.

Furthermore, the partial or complete saccharification of wood and other vegetable raw materials by treatment with mineral acids at elevated temperature is known. In this case the hemicelluloses, especially the xylans, are removed from the vegetable raw materials in the so-called pre-hydrolysis thereby being hydrolysed to monomeric sugars, especially xylose, and being obtained as sugar molasses or as crystalline xylose. In the case of complete saccharification the pre-hydrolysis residue is treated with strong mineral acid, in which case the carbohydrates which are left after the pre-hydrolysis step and which consist mainly of cellulose are hydrolysed to monomeric sugars, mainly glucose, These known processes have the disadvantage that the lignin accumulates in so strongly condensed a form that as a rule it can only be burnt for energy production. In addition, difficulties are encountered, on an industrial scale in the production of pure glucose, especially crystalline glucose—also called dextrose, according to this saccharification process.

An object of the present invention is the provision of a process for the production of sugars, especially xylose and glucose, and optionally fibrous materials, especially cellulose and lignin, in which the sugars are obtained in high purity and high yield, the lignin is obtained in still reactive form as a powder and, optionally, other valuable by-products are obtained. Preferably, the xylose produced by the process of the invention is destined for reduction to xylitol. Thus, improvements in the purity of the xylose allows the production of highly pure xylitol with fewer complications in carrying out the reductive process.

According to the present invention there is provided a process for the production of sugars, and optionally, cellulose and/or lignin, from lignocellulosic vegetable raw materials by treatment with a mixture of water and lower aliphatic alcohols and/or ketones at elevated temperature and pressure followed by separation of fibrous materials, organic solvents and lignin from the treatment solution, which is characterised in that:

(a) the vegetable raw materials are treated with a mixture of water and lower aliphatic alcohols and/or ketones at a temperature of from 100° to 190° C. for a period of from 4 hours to 2 minutes, the temperature and duration of treatment being so chosen that less than about 20%, preferably less than about 10% by weight of the main component of the hemicelluloses, contained in the vegetable raw material, are split and go into solution, components which are soluble without chemical decomposition being dissolved, together with dissociation products of those substances chemically decomposed in conditions, in which the main component of the hemicelluloses is not yet split to the extent mentioned and goes into solution;

(b) the residue is separated;

(c) the latter is treated with a mixture consisting of approximately equal parts by volume of water and of lower aliphatic alcohols and/or ketones at temperatures of 120° C. to 220° C. preferably 170° to 220° C. for a period of from 6 hours to 2 minutes, preferably from 180 to 2 minutes, the temperature and duration of treatment being so chosen that the main component of the hemicelluloses is split in the solvent used to soluble carbohydrates;

(d) fibrous materials are separated from the solution;

(e) oligosaccharides and polysaccharides which may still be present in the solution freed from fibrous materials are subjected to acid hydrolysis at the chemical treatment temperature or a lower temperature and, subsequently, the organic solvent and lignin are separated, or the organic solvent and lignin are first separated from the chemical treatment solution and the oligosaccharides and polysaccharides which may still be present are submitted to hydrolysis in the aqueous phase;

(f) if desired, monosaccharides, obtained by hydrolysis of the main component of the hemicelluloses, are recovered from the aqueous solution;

(g) if desired, monosaccharide obtained by hydrolysis of the main component of the hemicelluloses, optionally without isolation from the solution so obtained, is reduced to the corresponding sugar-alcohol;

(h) if desired, suitably washed cellulose is split to glucose and this is recovered and/or, (i) if desired, glucose, optionally without isolation from the solution so obtained, is reduced to sorbitol or fermented to ethyl alcohol.

The pre-treatment effected in stage (a) is preferably carried out using a mixture of approximately equal parts by volume of water and lower aliphatic alcohols and/or lower aliphatic ketones. However, this pretreatment can be effected using any desired ratio although it may be advantageous to use a greater amount of water.

Examples of raw materials used according to the invention, the hemicellulose main component of which consists of xylans, and which, therefore, are suitable for the production of xylose and xylitol are hardwoods, straw, bagasse, cereal husks, corn-cob residues, nutshells and other lignocellulosic materials which possess a xylan content of e.g. above about 15% by weight, preferably above about 25% by weight. However, it is clearly to be understood that according to the invention vegetable raw materials with a lower xylan content, such as soft woods, can also be employed, especially when the production of lignin, cellulose, glucose and/or the production of mannose from mannan-rich vegetable raw materials is of great economic interest. The choice of raw material will, of course, also be dependent on the local availability of vegetable raw materials.

Extensive references to the use of vegetable raw materials, the hemicelluloses of which mainly consist of xylans, are made in the following text. However, it should be noted that, according to the process of the invention, vegetable raw materials, which are rich in mannans—a hemicellulose also widely found in nature—can be similarly processed to yield mannose and secondary products—as well as lignin and cellulose, etc. Accordingly, the definition "main component of the hemicelluloses", as used herein, means those hemicelluloses which form the main component of the hemicelluloses in the vegetable raw materials which are to be subjected to the process of the invention. The reason for this is that the production of decomposition products of those hemicelluloses contained only in minor amounts in a particular vegetable raw material is not of special interest, since an essential feature of the invention consists in decomposing the hemicellulose forming the major part of the particular vegetable raw material being treated, i.e. the main component of the hemicellulose present therein, to monosaccharides, to recover and, optionally, to reduce them to the corresponding sugar-alcohols.

According to a preferred aspect of the invention, the treatment of the raw materials is carried out so that chemical decomposition of cellulose and lignin is avoided as far as possible whereas hydrolysis of the main component of the hemicelluloses, especially xylan, i.e. the conversion of the polysaccharide to water-soluble dissociation products, is desirable. Chemical treatment therefore is effected so that as high a proportion as possible of the lignins and xylans or other hemicelluloses go into solution so that very pure cellulose remains as solid. The processing of the reaction solution is effected so that in as simple a manner as possible as far-reaching a separation as possible of lignin and xylan or other hemicellulose dissociation products is effected, in which case as reactive lignin as possible, in solid form, and dissolved xylan or other hemicellulose dissociation products are obtained in as high a concentration and purity as possible.

By "approximately equal parts by volume", concerning the quantitative ratios of water to organic solvents within the meaning of the invention, there is meant a volume ratio of from 70:30 to 30:70, preferably from 60:40 to 40:60. The chemical treatment temperatures should lie in step (a) within the range of from 100° to 190° C. and in step (c) preferably within the range of from 170° to 220° C. If the temperatures selected are too high, undesirable chemical changes occur in the raw material components, e.g. the yield and degree of purity of the xylan or other hemicellulose dissociation products decrease and the lignin becomes less reactive. At too low a temperature, however, chemical treatment may be insufficient, in the sense that inadequate hydrolysis of the xylan or other hemicelluloses takes place. In addition, chemical treatment may take too long at too low a temperature. The chemical treatment periods in each step should preferably be from 2 to 180 minutes and, particularly advantageously, from 5 to 60 minutes.

Chemical treatment temperatures and chemical treatment periods are to be adapted to the particular raw material used. It is easy to ascertain experimentally which temperatures and chemical treatment periods are the best for obtaining the effects defined in steps (a) and (c).

According to a preferred embodiment of the invention small quantities of proton donors especially acids, are added to the chemical treatment solution. Addition of acid makes it possible to treat chemically those vegetable raw materials that can be chemically treated only with difficulty or inadequately without acid addition. This is true for instance of soft woods. The acids used can be mineral acids, such as nitric acid, phosphoric acid, sulphurous acid, and preferably sulphuric acid or hydrochloric acid; or organic acids, such as formic acid, acetic acid or oxalic acid. The optimum acid concentration depends on the acid used and on the type of raw material used. If hydrochloric acid is used the chemical treatment solution generally should be at from 0.001 to 0.3N, preferably from 0.005 to 0.1N and more preferably from 0.01 to 0.05N of acid, related to the total volume. If oxalic acid is used the chemical treatment solution should be at from 0.001 to 1N, preferably from 0.005to 0.3N and more preferably, from 0.01 to 0.1N of acid, related to the total volume. If other acids are used the optimum concentration of acid can be ascertained in simple experiments by those skilled in the art. The proton donors used can also be acid salts, such as ammonium chloride, and/or acid-reacting phenolic compounds, e.g. phenol.

In the case of vegetable raw materials which apart from the acids liberated by the treatment with water/-solvent mixtures at elevated temperature—especially acetic acid and formic acid—contain other particularly strongly acid reacting substances, such as the thujaplicines in thuja species, addition of acid can possibly be completely dispensed with.

It is a great advantage that through the addition of acid the chemical treatment is effected very rapidly. For example, when using mixtures of water and acetone and from 0.02 to 0.03N hydrochloric acid at 200° C. the hemicelluloses in hardwoods and soft woods—mainly xylans in the case of hardwoods and mainly mannans in the case of soft woods—and the greater part of the lignin as a rule, go into solution within 5 minutes without significant quantities of low-molecular products being split off from the cellulose. Furthermore, it is a great advantage and could not have been expected by those skilled in the art that in this case the xylans or mannans respectively are dissociated to the corresponding monomeric sugars and the lignin largely remains reactive and soluble in organic solvents. If chemical treatment is effected in the presence of acid, acetone is particularly suitable as solvent. This is especially true of the chemical treatment of soft woods. Acetone is also preferred among the ketones as solvent for the reason that it is particularly readily available.

The term "lower aliphatic alcohols and/or ketones" as used herein means, in the case of alcohols, those alcohols having from 1 to 6, preferably from 1 to 4, most preferably 2 or 3 carbon atoms and in the case of ketones, those ketones having from 3 to 6, preferably from 3 to 5, most preferably 3 or 4 carbon atoms. $C_{1-4}$ alkanols, especially ethanol and isopropanol among the alcohols and acetone among the ketones are particularly preferred.

According to the invention, the vegetable raw materials are submitted in step (a) to a chemical treatment, described here as "chemical pre-treatment". This chemical pre-treatment like the main chemical treatment can be carried out with a mixture consisting of approximately equal parts by volume of water and of lower aliphatic alcohols and/or ketones. According to the particular raw material used, small quantities of acid can be added to the solvent mixture, as a result of which the chemical treatment period is reduced. However, chemical pre-treatment can also be carried out at pH-values of from 4 to 8, preferably from 4 to 7, by addition of buffer salts, such as phosphate salts. In this case, the easily soluble impurities are dissolved out slowly and very gently, under consequently very good control by way of the chemical treatment period. It is particularly advantageous in this case, however, to work with addition of acid in the subsequent main chemical treatment, as, otherwise, the hemicelluloses are dissolved out of the pre-treated raw material insufficiently or too slowly.

Chemical pre-treatment can, if desired, also be effected with steam, optionally under pressure, as is described in detail in the West German Unexamined Patent Applications (Offenlegungsschriften) Nos. 2 732 289 and 2 732 327.

This performance of the chemical pre-treatment before the actual main chemical treatment is an essential feature of the present invention. Surprisingly, this achieves the result that the monosaccharides, obtained by decomposition of the hemicelluloses, e.g. xylose, are obtained in considerably improved purity, with otherwise simple process operation. In addition, lignin, accumulates in a purer and more pulverulent form, so that separation is facilitated.

The chemical pre-treatment with solvent/water mixtures is carried out under somewhat milder conditions than the main chemical treatment. Temperatures within the range of from 100° to 190° C., preferably within the range of from 150° to 180° C., are suitable. The treatment period suitably is from 4 hours to 5 minutes, preferably from 60 to 10 minutes.

If from 0.001 to 1N mineral or organic acid is added to the solvent/water mixture considerably shorter treatment periods result, i.e. significantly less than 5 minutes. The treatment periods on using buffer salts lie within the range indicated above. What is essential is that temperature and period of treatment are chosen so that less than about 20% by weight, preferably less than about 15% by weight, more preferably less than about 10% by weight, most preferably less than about 5% by weight of the main component of the hemicelluloses contained in the vegetable raw material, especially the xylans, are split and go into solution. At the same time, however, the components which are soluble without chemical decomposition are dissolved as are the dissociation products of those substances that are chemically decomposed in conditions, in which the main component of the hemicelluloses, especially the xylans, are not yet split to the extent mentioned and go into solution. The conditions may vary, depending on the particular vegetable raw materials selected but the optimum conditions, within the meaning of the above explanations, can be easily ascertained for each case by means of simple experiments by those skilled in the art.

Subsequently the residue separated from the solution is subjected again with a mixture consisting of approximately equal parts by volume of water and organic solvent to the main chemical treatment. The temperatures lie suitably within the range of from 170° to 210° C., preferably from 180° to 200° C., while the reaction period is preferably from 180 to 10 minutes, more preferably from 30 to 70 minutes. If mineral or organic acids are added to the solvent/water mixture the treatment periods must be kept shorter so as to avoid decomposition of desired sugars being formed, especially xylose, and attack of the cellulose. Temperature and duration of treatment are chosen in each case so that in particular the xylans are split as completely as possible to xylan fragments soluble in the solvent mixture applied and/or to xylose that, therefore, as far as possible no hemicelluloses that can be split by the action of organic solvent and water and, similarly, no lignin remain in the fibrous material. The residue therefore is as pure cellulose as possible.

For the production of particularly pure hemicellulose fragments, on the one hand, and of pure cellulose, on the other, it has proved advantageous with many vegetable raw materials to carry out after the main chemical treatment a further treatment of the fibrous material residue of the main chemical treatment corresponding to a main chemical treatment with addition of acid. At this stage residual amounts of hemicelluloses and lignins and, if desired, amorphous components of cellulose are removed.

Care should be taken after completion of the main chemical treatment that no significant quantities of the organic solvent are removed from the chemical treatment solution before the separation of the fibrous materials as with increasing relative water content in the solution the water-insoluble lignin increasingly precipitates, and is then deposited on the fibrous material. The same tendency is shown on cooling the chemical treatment solutions. Accordingly, it is advantageous to carry out the filtration of the fibrous materials from the chemical treatment solution at higher temperatures, optionally under pressure, and under these conditions optionally to carry out also the re-washing of the fibrous materials with fresh chemical treatment solution.

According to the invention, re-washing can be carried out with water or organic solvents or their mixtures preferably a mixture of from 0 to 70 parts by volume of water and from 100 to 30 parts by volume of lower aliphatic alcohols and/or ketones, also with weak alkali solution or alternatively it may be left. In the case of re-washing with fresh chemical treatment solution, the solution for the next chemical treatment (main chemical treatment) can be used or processed as the chemical treatment solution for the production of the xylan dissociation products and of the lignin (see later). The use of the re-washing solution for the (main) chemical treatment can be advantageous for some raw materials. The re-washing already possesses the optimum pH-value for dissolving out the xylan or other hemicelluloses and the lignin. Therefore, optimum conditions for chemical treatment exist in the reaction mixture from the start. According to the composition of the re-washing solution and depending on the properties of the raw material used the reaction time and/or the reaction temperature may be reduced.

On re-washing the fibrous materials with hot solvents or solvent/water mixtures, more lignin in particular is dissolved out of the fibrous materials. If production of lignin is less important, it is possible to obtain soluble xylan dissociation products remaining in the fibrous material after the chemical treatment by re-washing with water, preferably in the hot state. On re-washing the fibrous materials with weakly alkaline aqueous solutions, large amounts of the lignin as well as xylan and xylan fragments are brought into solution very rapidly. In addition, in the case of raw materials for which chemical treatment is difficult the fibrous materials thus treated frequently show higher digestibility values.

Re-washing with solvent/water mixtures or water can also be dispensed with if the production of fibrous materials, e.g. for animal fodder purposes, is the main or exclusive production aim of the invention.

If, in accordance with the invention, optimum chemical treatment conditions adapted to xylan-rich raw materials are selected, xylan fragments in high purity and concentration mainly present as oligosaccharides and polysaccharides, are obtained in the chemical treatment solutions after separation of the fibrous materials in chemical treatment without additions of mineral or organic acids. These saccharides can be hydrolysed for the production of xylose, before separation of the solvent and of the lignin in a manner corresponding to the main chemical treatment with addition of acid. A similar procedure can be followed if in chemical treatment operations with acid small quantities of dimeric and oligomeric sugars, in addition to monomeric sugars, are present in the chemical treatment solution separated from the fibrous material.

In accordance with a further embodiment of the process according to the invention the above-mentioned xylan fragments separated from the fibrous material can be precipitated from the chemical treatment solution by addition of a solvent, such as ethanol, and separated. According to this process variant, they accumulate in very pure form. It is extremely surprising that these xylans and xylan fragments, after hydrolysis, yield practically pure xylose, free from 4-O-methylglucuronic acid. The solution obtained after separation of the xylans and xylan fragments can be processed further as described below. Removal of the organic solvent from the reaction solution can be effected e.g. by distillation from the superheated solution or of cooler solutions. In the first place, this serves for recovery of the solvent and, secondly, for the separation of the lignin. According to the invention recovery of the organic solvent, is preferably effected by vacuum distillation of the reaction solutions, cooled in heat-exchange to about 40° C., as the water-insoluble lignin accumulates in pulverulent form at this temperature and can be separated by comparatively simple means, e.g. by filtration, while at high temperatures lignin is usually precipitated in the form of smeary to viscous or agglomerated masses.

According to the invention, it is of particular advantage that the precipitated lignin accumulates in a less smeary and more pulverulent form.

It should be stressed here, however, that regardless of in what form the lignin is obtained the aqueous phases remaining after removal of the organic solvents should be light-coloured in correctly selected chemical treatment conditions, i.e. they do not contain more than small quantities of lignin-like products.

The chemical treatment solutions contain, depending on the rigouressness of the chemical treatment conditions, varying percentages of furfurol. This furfurol represents a valuable by-product.

If according to the invention optimum chemical treatment conditions adapted to the raw material are chosen, the xylan dissociation products in the aqueous phases of the chemical treatment solutions are obtained in high purity and concentration. If the xylan dissociation products are not yet present in the form of xylose, as is the case in chemical treatment with addition of acid or in the hydrolysis of the chemical treatment solution before separation of the solvent and of the lignin, it is useful, in the further processing to xylose, to carry out an acidic hydrolysis without previous purification of the solution, since, under the influence of acid, not only hydrolysis of the xylan dissociation products is effected, but, at the same time, a conversion of water-soluble impurities into water-insoluble products, which can be separated very simply from the hydrolysates by filtration occurs. It is of particular advantage that hydrolysis and separation of impurities can be effected in one working step and, furthermore, it is of particular advantage that the hydrolysis of the xylan dissociation products, obtained in accordance with the process of the invention, as low molecular weight sugars in the aqueous phases can be undertaken under considerably milder conditions, e.g. with the use of lower acid concentrations, than hydrolysis of the xylans in the tissue of the vegetable raw materials, i.e. hydrolysis of e.g. wood or straw. The proportion of xylose of the total carbohydrates of the hydrolysates is, on average, 85% and the concentration of xylose in the solutions about from 4 to 9%.

According to the invention, an aqueous solution, essentially containing only xylose, is obtained after separation of the organic solvent and of the lignin and carrying out of the hydrolysis. Xylose can be isolated from this solution in a manner that is known per se, if it is desired as such. Other sugars, contained in the solution, particularly glucose, can be easily removed on recrystallisation, as they are present in only small quantities.

If it is desired that xylitol is produced from the xylose it is useful first to purify the hydrolysate, e.g. over ion-exchangers. Anion-exchangers bind the 4-O-methylglucuronic acid as well as the acid used in the acidic hydrolysis, whereas xylose can freely pass through the exchanger column, (cf. K. DORFNER: *Ionenaustauscher*), Walter de Gruyter Publishing Company, Berlin 1970, p 267; M. SINNER, H. H. DIETRICHS and M. H. SIMATUPANG, *Holzforschung*, 26 218-228

(1972). Surprisingly, the amount of 4-O-methylglucuronic acid in the hydrolysate is extremely low in the process according to the invention.

A particular defined aim of the process according to the invention consists in further processing the purified xylose, obtained in accordance with the above process, to xylitol in known manner, preferably by catalytic hydrogenation, (cf. West German Unexamined Patent Applications (Offenlegungsschriften) Nos. 2 536 416 and 2 418 800, West German Examined Patent Applications (Auslegeschriften) Nos. 2 005 851 and 1 066 567, West German Unexamined Patent Application (Offenlegungsschrift) No. 1 935 934 and French Patent Specification No. 2 047 193). In this embodiment, therefore, xylitol is produced in a highly pure form by an economic process in a simple manner from vegetable raw materials possessing a high xylan content (cf. West German Examined Patent Application (Auslegeschrift) No. 1 066 568) with simultaneous production of further valuable products.

The xylan dissociation products contained in the aqueous phases as well as the xylose, obtainable from the latter, can also be reacted to furfurol. It is not necessary for this purpose that the xylose be first separated in pure form. Similar considerations apply e.g. to the use of the xylose as a substrate for the production of protein.

It is known and has already been mentioned above that fibrous materials, obtained in accordance with processes of this kind, can be used in paper production. This kind of application is not impaired by the chemical treatment conditions used according to the invention. Hardwoods and annuals as well as soft woods, which cannot be chemically treated, or treated only with difficulty, according to the prior chemical treatment processes, with solvent-water mixtures, such as pine, Douglas fir and spruce, can be used, according to the process of the invention, for the production of paper pulp. For this purpose, acetone/water mixtures of from 60:40 to 40:60 by volume with a mineral acid or, preferably, an organic acid are particularly suitable for soft woods. When using mineral acids, the concentration, related to the total volume of chemical treatment solution, should preferably have a strength of from 0.005 to 0.1N and, in the case of organic acids, from 0.01 to 1N of acid.

Another particularly advantageous embodiment of the process of the invention consists in subjecting the fibrous material residue obtained, which is predominantly of cellulose, to acid or enzymatic hydrolysis with production of glucose. This process is described in detail in West German Unexamined Patent Application (Offenlegungsschrift) No. 2 732 289. As the fibrous material obtained according to the invention possesses an extremely high degree of purity, i.e. it contains as carbohydrate predominantly cellulose, practically only glucose is formed during hydrolysis, in excellent yield. Since, furthermore, large proportions of the lignin have been dissolved by the chemical treatment according to the invention, the fibrous material thus obtained can also be enzymatically converted to glucose in high yield whereas, for example, wood cannot be enzymatically saccharified. The processing of the hydrolysis solutions can be effected in a known manner with production of glucose.

A further advantageous embodiment of chemical treatment with acidified solvent/water mixtures according to the invention consists in controlling the chemical treatment conditions—especially temperature, preferably from 180° to 200° C.—the treatment period, preferably from 5 to 30 minutes,—and acidity—preferably from 0.01 to 0.1N mineral acid,—in such a way that the fibrous residue contains the crystalline cellulose of the vegetable raw material almost completely and without major proportions of hemicelluloses and/or lignin and that, therefore, a crystalline cellulose of high purity is obtained. The degree of polymerisation of the cellulose can be controlled by the chemical treatment conditions depending on the vegetable raw material. These pure crystalline products find application e.g. as microcrystalline cellulose or for the production of rayon.

Another particularly advantageous embodiment of the process according to the invention consists in retreating the cellulose with a solvent/water mixture and, preferably, mineral acid, preferably from 0.01 to 0.1N acid, related to the total volume, preferably at temperatures of from 180° to 210° C. for a period of from 5 to 60 minutes.

The chemical treatment conditions should be selected so that the cellulose is almost completely split of glucose. In this connection, the application period of the reaction solution is critical since because of the high temperature and the low pH of the reaction solution, the glucose formed from the cellulose can further react to form 5-hydroxymethyl furfurol and undesirable decomposition products. It has therefore proved advantageous to carry out the treatment stepwise. This can be done in batches by separating the reaction solution at certain time intervals—particularly advantageously every 3 to 15 minutes—and replacing it with fresh solution until the fibrous material is completely hydrolysed—especially to glucose. It is particularly advantageous in this connection to employ heating-systems which ensure rapid and even heating-up. Stepwise hydrolysis of the cellulose to glucose, according to the process of the invention, can also take place in a continuously operating system. In this case, it is necessary that the application period or the rate of flow of the solution in the reaction space be accurately controlled. Glucose, obtained in the aqueous phase of the reaction solution in high yield and purity, after separation of the solvent can, after filtration of small solid impurities and, optionally, after separation of acid, be recovered in crystalline form in conventional manner, reduced to sorbitol, fermented to alcohol or used as a nutrient for micro-organisms or as fodder-molasses.

As has already been mentioned, differing amounts of glucose formed from the cellulose, are reacted to 5-hydroxymethylfurfurol, depending on the control of the chemical treatment conditions. This substance represents a valuable by-product which can be obtained from the condensates and on working up the aqueous phases of the reaction solutions, generally, in quantities of from 2 to 6%, relative to the raw material used.

Another particularly advantageous field of application for the fibrous material, obtained according to the invention, lies in its use as fodder for ruminants. Not only less highly lignified raw materials, like straw, but also the more highly lignified hardwoods and the highly lignified soft woods yield fibrous materials, which all produce higher digestive values in cattle than good quality hay. A large number of raw materials can be converted, with controlled chemical treatment, into fibrous materials, the digestibility of which lies above 90%. What is particularly advantageous is that the fibrous materials filtered off from the reaction solution, can be directly fed to the animals, i.e. without re-washing or other treatment since the carbohydrates which are precipitated on the fibrous materials thus obtained and are soluble per se, increase the nutritive value of the product.

Important technical advantages of the process of the invention are that no environmentally harmful chemicals are used, that the chemicals used are applied in very low concentration and that all the components of the vegetable raw materials used are brought to economic use.

The invention will now be further illustrated with reference to the following non-limitative Examples.

EXAMPLE 1

Chemical treatment of woods and straw

Air-dried wood-chips having dimensions approximately 2×2×6 mm (or finely chopped straw) were treated in accurately weighed portions—moisture being determined in parallel—in quantities of about 5 g (about 3 g for the straw) with 30 ml of a mixture of ethanol and water in a volume ratio of 1:1 in a small autoclave. The temperature and times of treatment can be ascertained from the following Table. It was possible to avoid prolonged heating and cooling times by introducing the autoclave, after filling and closure into a suitably tempered oil-bath, enabling it to cool down rapidly in a cold oil-bath at the end of the reaction-period. Chemical pre-treatments were carried out in some instances (a-series, see Table 1). In these cases, the solvent mixture was filtered from the solids after completion of the pre-treatment and replaced by fresh solvent mixture. After completion of the main chemical treatments solids were separated from the reaction solution by filtration and re-washed with fresh solvent/water mixture until the filtrate ran clear. The fibrous material was subsequently dried in an air-conditioned room (20° C., 65% relative humidity) on average, a moisture content of 10% resulting in the materials. The yield was calculated taking this factor into account. The combined reaction and re-washing solutions were subjected to vacuum distillation at temperatures of from 40° to 50° C. until the ethanol present in the solution had been removed. The remainder of the solution was made up with water to exactly 100 ml and the precipitated lignin separated by decantation, dried and weighed. Added to this weighed result was the hydrolysis residue (approximately), which was precipitated in the total hydrolysis of the aqueous solution. The total hydrolysis was effected according to the directions of I. J. Saeman, W. E. Moore, R. L. Mitchell and M. A. Millet, (TAPPI, 37, 336–343 (1954)). The sugars in the hydrolysate were determined quantitatively. Aliquot portions of the fibrous materials were similarly submitted to total hydrolysis and the sugars in the hydrolysates determined quantitatively. The sugar analysis was carried out in a Biotronik auto-analyser, which is described in detail in West German Patent Application No. P 26 57 516.6 filed on Dec. 17, 1976 and entitled "Colour reagent and process for automatic sugar chromatography". The test results are shown in Table 1, but reference should also be made to the chromatograms depicted in the accompanying drawings. Some of the aqueous and alcoholic phases of combined reaction and re-washing solutions, obtained by vacuum distillation, were quantitatively tested for furfurol. The furfurol determination was effected by measurement of the light absorption of the eluate of the separating column by means of a flow photometer at 280 nm before the colour reagent for the determination of the sugars was added to the column eluate. This process is described in detail in West German Patent Application No. P 27 32 288.9, filed on July 16, 1977 and entitled "Process for the automatic separation and quantitative determination of furfurols and/or of lower aliphatic aldehydes, optionally in admixture with sugars". Examples of the furfurol content of aqueous phases are shown in Tables 3, 6 and 7 (Example 7 and 10) and in the accompanying drawings.

TABLE 1

| raw material | chemical treatment conditions temp. °C. | time min. | dissolved "lignin" %, related to raw material | dissolved carbohydrates total %, related to raw material | xylose % related to dissolved carbohyd. | fibrous material residues total %, related to raw material | hydrolysis residue %, related to fibrous material | sugar %, related to total carbohydrate glucose | xylose |
|---|---|---|---|---|---|---|---|---|---|
| 1. red beech | 190 | 65 | 11.5 | 13.1 | 82 | 61.5 | 24 | 84 | 15 |
| 2a red beech | 170 | 20 | 2.2 | 1.2 | 33 | 93.4 | — | — | — |
| 2b red beech | 190 | 65 | 13.8 | 15.0 | 86 | 55.7 | 21 | 86 | 12 |
| 3. birch | 200 | 65 | 24.1 | 12.5 | 79 | 51.7 | 19 | 85 | 13 |
| 4a birch | 170 | 25 | 2.8 | 2.5 | 54 | — | — | — | — |
| 4b birch | 190 | 50 | 14.2 | 18.2 | 86 | 53.0 | 13 | 86 | 13 |
| 5. oak | 200 | 65 | 17.1 | 14.9 | 67 | 48.3 | 19 | 91 | 8 |
| 6a oak | 160 | 25 | 3.4 | 4.8 | 30 | — | — | — | — |
| 6b oak | 190 | 50 | 10.2 | 14.8 | 81 | 64.9 | 11 | 91 | 8 |
| 7. wheat straw | | | | | | | | | |
| 8a wheat straw | 160 | 25 | 3.3 | 1.5 | 19 | — | — | — | — |
| 8b wheat straw | 190 | 50 | 11.1 | 18.5 | 80 | 46.9 | 22.0 | 86 | 13 |

EXAMPLE 2

Digestibility of the fibrous materials in ruminants

About 3 g each of the accurately weighed air-dried fibrous materials—moisture being determined in parallel—obtained in accordance with Example 1 were sewn into porous polyester fabric bags and introduced for 48 hours into the rumen of fistulated cattle. Subsequently, the bags and contents were thoroughly washed and dried. The decomposition values in the rumen were determined by re-weighing.

| fibrous materials (according to Example 1) | | decomposition in the rumen = digestibility (%) |
|---|---|---|
| red beech | 1 | 84 |
| birch | 4b | 98 |
| oak | 6b | 99 |

EXAMPLE 3

Enzymatic hydrolysis of fibrous materials

About 200 mg each of the accurately weighed air-dried fibrous materials—moisture being determined in parallel—obtained in accordance with Example 1 were incubated with 25 mg of a product, obtained by dialysis and subsequent freeze-drying from the commercial enzyme preparation, Onozuka SS, (ALL Japan Biochemical Co, Nishinomiya, Japan) in 5 ml of 0.1M sodium acetate buffer, pH 4.8, in a closed Erlenmeyer flask at 46° C. in a shaking water-bath. The solutions were treated against attack by microorganisms with thimerosal (28 mg/liter). Control samples were incubated without enzyme addition. After 24 hours of incubation the remaining residue was separated by suction on a sintered glass filter and weighed after drying. In addition, the extent of decomposition was determined by quantitative sugar analysis of the decomposition solutions. The latter values were about 10% higher than the gravimetrically determined values. This is explained by the addition of water in the hydrolysis of polysaccharides to monosaccharides.

| fibrous materials (according to Example 1) | | sugar % in the hydrolysate, related to fibrous materials | sugar % composition in the hydrolysate | |
|---|---|---|---|---|
| | | | glucose | xylose |
| red beech | 1 | 48 | 84 | 15 |
| birch | 4b | 85 | 86 | 13 |
| oak | 6b | 89 | 91 | 8 |
| wheat-straw | 8b | 84 | 87 | 13 |

EXAMPLE 4

Comparative acid hydrolysis of xylan dissociation products and wood

Concentrated $H_2SO_4$ was added to 20 ml of an aqueous phase, obtained from birch-wood (sample 4b) according to Example 1 and containing about 70 mg of xylan and xylan dissociation products so that the solution contained 0.5% of $H_2SO_4$ in all. The solution was boiled in a flask filled with a reflux-condenser and the course of hydrolysis reductometrically followed (cf. M. SINNER and H. H. DIETRICHS *Holzforschung* 30, 50–59 (1976)). As a comparative experiment, 1.8 g of beech-wood chips (sieve fraction 0.1–0.3 mm) were treated with 20 ml of 0.5% aqueous $H_2SO_4$ in a closed flask in a boiling water bath in a similar manner.

The xylan dissociation products, obtained in accordance with the invention, had been almost 70% hydrolysed after 20 minutes and completely after 2 hours. 3% of reducing sugars, mostly xylose, had been liberated after ½ hour from the wood (which is known to contain about 28% of xylan) 8% after 3 hours and almost 10% after 9 hours.

On application of a $H_2SO_4$ concentration of 2.5%, complete hydrolysis of the xylan dissociation products in the aqueous phase of the reaction solution was effected within 45 minutes.

EXAMPLE 5

Enzymatic hydrolysis of xylan dissociation products 30 mg of xylanase, fixed to porous glass, as well as 30 mg of beta-xylosidase, fixed to porous glass, were added to 2 ml of an aqueous phase of the chemical treatment solution of red beech (sample 2b), obtained in accordance with Example 1, and incubated in a shaking water-bath at 40° C. The xylan dissociation products, contained in the decomposition solution, had been completely hydrolysed to xylose after 15 hours. The xylan dissociation products of the aqueous phase of a chemical treatment solution of birch (sample 4b) were hydrolysed in a similar manner. Water-soluble impurities in the aqueous phase did not impair enzymatic activity.

The carrier-fixed enzyme preparations had been produced according to German Patent Application (Offenlegungsschrift) No. 2 643 800.6, (Process for the production of xylose by enzymatic hydrolysis of xylans). Determination of the carbohydrate composition in the decomposition solution was effected by quantitative sugar analysis in the Biotronik auto-analyser, (cf. M. SINNER, M. H. SIMATUPANG and H. H. DIETRICHS, *Wood Science and Technology* 9, 307–322 (1975)).

EXAMPLE 6

Chemical pre-treatments with and without buffer

Air-dried wood-chips were treated, in accordance with Example 1, with mixtures of ethanol, acetone or isopropanol and water or aqueous buffer solution in the same volume ratio. The buffer solution contained 0.3M $KH_2PO_3/K_2HPO_3$ and possessed a pH-value of 7. The results in the table show that removal of sugars and impurities which are undesirable in the subsequent main chemical treatment—not shown—can be controlled by the duration or the temperature of the treatment.

Chromatograms of the sugar analyses are shown in the accompanying drawings.

TABLE 2

| Chemical pre-treatments | | | | | | | | | |
|---|---|---|---|---|---|---|---|---|---|
| | | Chemical treatment conditions | | | Dissolved phenolic substances, related | Dissolved carbohydrates, related to raw material | | | Yield of treated raw material, |
| Raw material | Solvent | aqueous phase | temperature °C. | time min. | to raw material % | total % | xylose % | mannose % | related to raw material % |
| beech | ethanol | buffer | 170 | 35 | 2.8 | 1.1 | 0.1 | | 91.9 |
| beech | ethanol | buffer | 180 | 35 | 3.8 | 1.8 | 0.6 | | 86.6 |
| beech | ethanol | buffer | 190 | 35 | 6.1 | 3.0 | 1.7 | | 77.3 |
| beech | isopropanol | buffer | 180 | 35 | 4.8 | 1.6 | 0.6 | | 90.4 |
| beech | ethanol | water | 170 | 20 | 2.2 | 1.2 | 0.4 | | — |
| oak | acetone | water | 160 | 10 | 2.0 | 1.0 | 0.02 | | 89.2 |
| oak | ethanol | water | 160 | 25 | 3.4 | 4.8 | 1.4 | | 83.9 |

TABLE 2-continued

| Raw material | Solvent | Chemical pre-treatments: Chemical treatment conditions: aqueous phase | temperature °C. | time min. | Dissolved phenolic substances, related to raw material % | Dissolved carbohydrates, related to raw material: total % | xylose % | mannose % | Yield of treated raw material, related to raw material % |
|---|---|---|---|---|---|---|---|---|---|
| birch | ethanol | water | 170 | 25 | 2.8 | 2.5 | 1.3 | | 90.6 |
| birch | acetone | water | 160 | 30 | 1.8 | 0.9 | 0.3 | | 94.6 |
| spruce | ethanol | water | 170 | 20 | 2.9 | 1.8 | | 0.7 | 89.0 |
| spruce | acetone | water | 170 | 15 | 2.1 | 0.6 | | 0.02 | |

EXAMPLE 7

Chemical treatment with acid

Moist oak-wood material, which had been obtained from 5.4 g of air-dried oak-wood chips—corresponding to 5.0 g on a completely dry basis; chip size: 2×2×6 mm—by chemical pre-treatment with acetone/water for 10 minutes at 160° C. (cf. Table 2, Example 6) was treated with 29 ml of acetone/water (volume ratio: 1:1) containing 0.025N hydrochloric acid, in accordance with Example 1 for 5 minutes at 200° C., the fibrous residue washed and the solution worked up. After removal of the acetone by vacuum-distillation and filtration of the lignin precipitated in the process, a clear light brownish-yellow solution was obtained. This solution without further treatment and after additional complete hydrolysis was quantitatively examined for sugars and furfurols in the Biotronik auto-analyser in accordance with Example 1. No precipitate was deposited during the additional hydrolysis; the solution remaining clear and light-coloured. The untreated solution possessed a concentration of monomeric sugars of 6.9%. The additional hydrolysis treatment increased this value to 8.9%, of which 76% was xylose. Furfurol could be detected only in traces in the untreated solution. Further analytical results are listed in Table 3. All percentage data in the Table relate to the raw material used, i.e. to the untreated wood (completely dry) with the exception of the data concerning the purity of xylose and mannose. Only a small aliquot portion (100 mg) was taken from the fibrous material obtained for the approximate determination of yield, so as to have as large a quantity of fibrous material as possible available for the production of cellulose and glucose (Examples 9 and 10).

Spruce-wood material which had been obtained from 6.5 of air-dried spruce-wood chips—corresponding to 6.0 g on a completely dry basis, chip size: 4×8×15 mm—by chemical pre-treatment with ethanol/water for 20 minutes at 170° C. (cf. Table 2, Example 6) was chemically treated with acetone/water (volume ratio: 1:1; liquor ratio: 1:10) containing 0.050N oxalic acid for 10 minutes at 200° C. and otherwise in an identical manner as the oak-wood material. The analytical values are shown in Table 3 and a chromatogram of the sugar analysis is reproduced in the accompanying drawings.

TABLE 3

(Main) chemical treatment of oak-wood and spruce-wood with acidified acetone/water.

| products in aqueous phase | | OAK | SPRUCE |
|---|---|---|---|
| lignin | | | |
| lignin filtered | % | 13.5 | 8.8 |
| hydrolysis residue | % | 0.0 | 0.3 |
| carbohydrates | | | |
| monomeric sugars | % | 20.8 | 11.6 |

TABLE 3-continued (Main) chemical treatment of oak-wood and spruce-wood with acidified acetone/water.

| products in aqueous phase | | OAK | SPRUCE |
|---|---|---|---|
| of this % xylose | | 74 | |
| of this % mannose | % | | 34 |
| monomeric sugars after | | | |
| hydrolysis | % | 25.8 | 17.7 |
| of this % xylose | | 76 | |
| of this % mannose | | | 58 |
| furfurol | % | 0.1 | 0.1 |
| residue (fibrous material) | % ca. | 45 | 65.3 |

EXAMPLE 8

Comparative chemical treatment of spruce-wood with acidified chemical treatment solutions using acetone and ethanol as solvents In accordance with Example 1, 5 g of air-dried spruce-wood, (chip-size: 4×5×15 mm) were treated with acidified (0.02N HCl) mixtures of acetone or ethanol and water, (volume ratio 1:1) for 20 minutes at 200° C. The liquor ratio was 1:10. The fibrous material residue was washed with solvent/water mixture (without acid) and with pure solvent and dried. The material, chemically treated with acetone was white; that chemically treated with ethanol was light-brown (see Table 4 for relevant data).

TABLE 4

| solvent | yield of fibrous material, related to raw material % | lignin related to fibrous material % | glucose related to fibrous material % | total carbohydrates % |
|---|---|---|---|---|
| acetone | 27.2 | 1.9 | 98.8 (92.3)* | 99.8 |
| ethanol | 45.5 | 12.5 | 92.4 (85.4)* | 99.3 |

*according to Saeman et al. 1954, (see Example 1) corrected values; in brackets: analytical values.

EXAMPLE 9

Production of pure cellulose

Fibrous materials, (from 1 to 3 g, calculated on a completely dry basis), of birch-wood and spruce-wood, which had been obtained after removal of undesirable substances by chemical pre-treatment (see Examples 6 and 1) and after separation of the greater part of the xylans and of the lignins by the main chemical treatment with ethanol/water (see Example 1) or with acidified acetone/water, respectively (see Example 7) were treated with acidified acetone/water (volume ratio: 1:1) at 200° C. in an autoclave in accordance with Example 1. The liquor ratio was from 1:5 to 1:6. The oak fibre material was treated twice in succession in the autoclave. The fibrous materials (washed) obtained were coloured light to snow-white. The analytical data obtained is compiled in Table 5. Two sugar-chromatograms reproduced in the accompanying drawings, clearly show the purity of the celluloses obtained.

In a similar manner, spruce-wood fibrous material was treated (yield: 47% of 6 g wood, on a completely dry basis) which had been obtained after removal of undesirable substances by chemical pre-treatment with ethanol/water (20 minutes, 170° C.; see Example 6) and separation of the greater part of the hemicelluloses—particularly galactoglucomannan—and of the lignin by a main chemical treatment of 15 minutes at 200° C. with acetone/water (volume ratio: 1:1; liquor ratio: 1:6) and 0.025N hydrochloric acid. Analytical data is shown in Table 5; and a relevant sugar chromatogram is reproduced in the accompanying drawings.

hydrolysis, were quantitatively examined for sugars and furfurols in the Biotronik auto-analyser, in accordance with Examples 1 and 7. The untreated aqueous phases possessed concentrations of monomeric sugars of up to about 5%. By means of additional hydrolysis treatment (complete hydrolysis) during which no insoluble substances were precipitated, this value was increased to a level somewhat above 5%, of which up to 98% was glucose. The quantities of 5-hydroxymethylfurfurol, left in the aqueous phases, after the reaction solutions had been worked up, were up to 4.7%, related to the wood used; apart from that up to 1.8% of furfurol was detected.

The products obtained—lignin, 5-hydroxymethylfurfurol, furfurol and sugar—including the residues left after the last chemical treatment step—represent up to

TABLE 5

| | | Cellulose from pre-treated fibrous materials | | | | | |
|---|---|---|---|---|---|---|---|
| | | chemical treatment with acetone/water at 200° C. concn. of hydrochloric acid | | fibrous material | | | |
| | | | | | | carbohydrate | |
| raw material | pre-treatment | N | time min. | yield, related to raw material % | hydrolysis residue, related to fibrous material % | total, related to fibrous material % | glucose, related to total carbohydrate % |
| birch | ethanol/water, 25 min., 170° C. and 50 min., 190° C. (see Example 1, birch, 4a,b) | 0.020 | 13 | 22.4 | 6.3 | 98.0(96.6)* | 99.2 |
| oak | acetone/water 10 min., 160° C. and 0.025N HCl/ acetone/water, 5 min., 200° C. (see Example 7) | | | | | | |
| 1st chem. treatment | | 0.025 | 7 | ca. 34 | 11.6 | 93.1(86.0)* | 99.7 |
| 2nd chem. treatment | fibrous material residue from 1st chem.treatment | 0.025 | 8 | ca. 26 | 14.9 | 83.1(76.8) | 99.9 |
| spruce | ethanol/water, 20 min., 170° C. and 0.025N HCl/ ethanol/water, 15 min., 200° C. | 0.025 | 10 | 38.5 | 10.9 | 91 (84) | 99.2 |

EXAMPLE 10

Production of glucose, furfurol and 5-hydroxymethylfurfurol

Fibrous materials (from 1 to 3 g) of birch-wood and oak-wood, which had been obtained after removal of undesirable substances by chemical pre-treatment (see Examples 6 and 1) and after separation of the greater part of the xylans and the lignins by the main chemical treatment with ethanol/water, acetone/water or acidified acetone/water (see Examples 1 and 7) were treated with acidified acetone/water mixtures (volume ratio: 1:1) at 200° C., once or several times in an autoclave in accordance with Example 1. The liquor ratio was about 1:6 in each step of the chemical treatment. Fibrous material residues of the individual chemical treatment steps were in each case separated from the reaction solutions and washed with acetone/water. The combined reaction solutions and washing solutions of the individual steps were worked up in accordance with Example 1 and the clear, light brownish-yellow aqueous phases, without further treatment and after additional complete above 90% of the fibrous materials used. If the impurities separated in the pre-treatments and the sugars and lignins obtained are added, total yields of from 77 to 89% result, related to the raw materials used. The difference contains ingredients, which were present in the raw materials or which had been formed from the raw materials during the temperature/pressure treatment, but which were not taken into account in the analyses performed. This includes mineral substances (ash: 1–2%) and acids (up to 6%); acetic acid and formic acid in particular are formed, mainly in the chemical treatment solutions of the pre-treatment step, (main chemical treatment) which can be recovered as valuable by-products of the process.

Relevant analytical data is shown in the following Tables 5, 6 and 7.

BRIEF DESCRIPTION OF THE DRAWINGS

Reference should be made to FIGS. 1 to 5 in the accompanying drawings in which there is reproduced chromatograms showing the sugar and furfurol analyses.

TABLE 6

Figure 1:
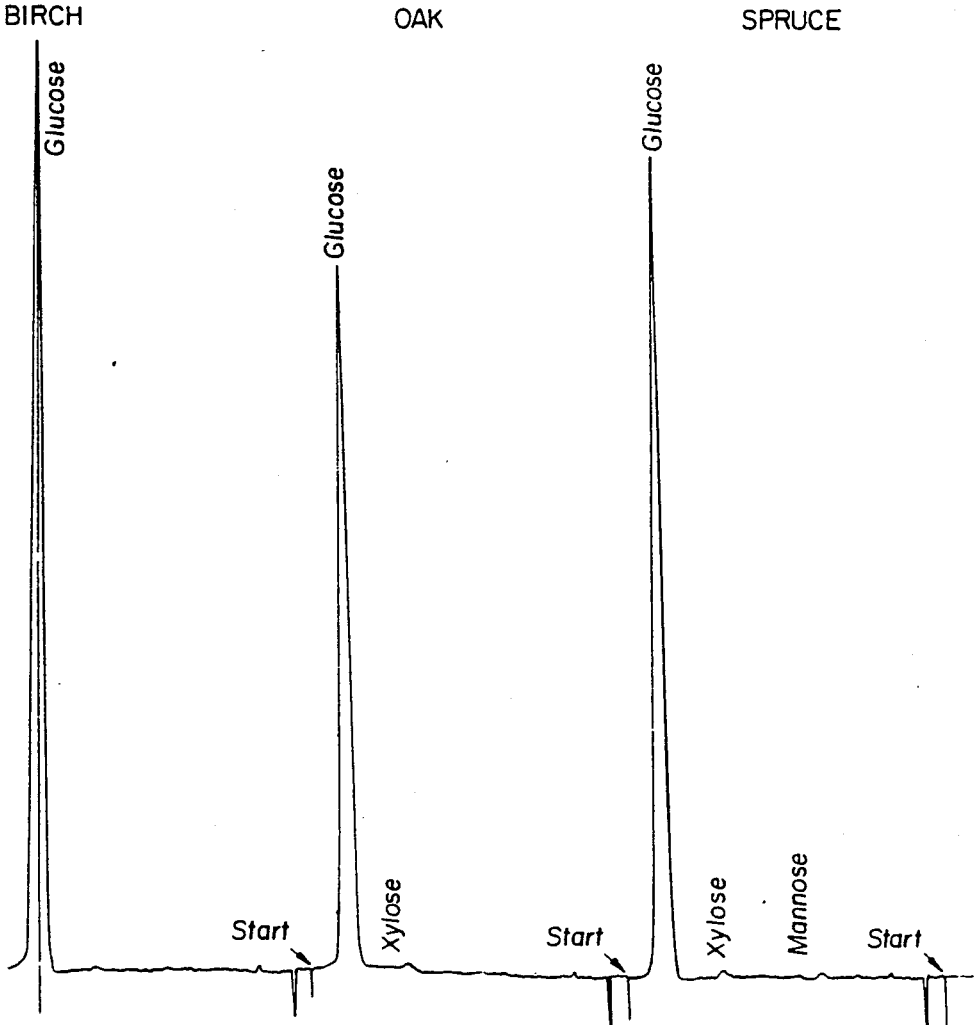
Figure 2:
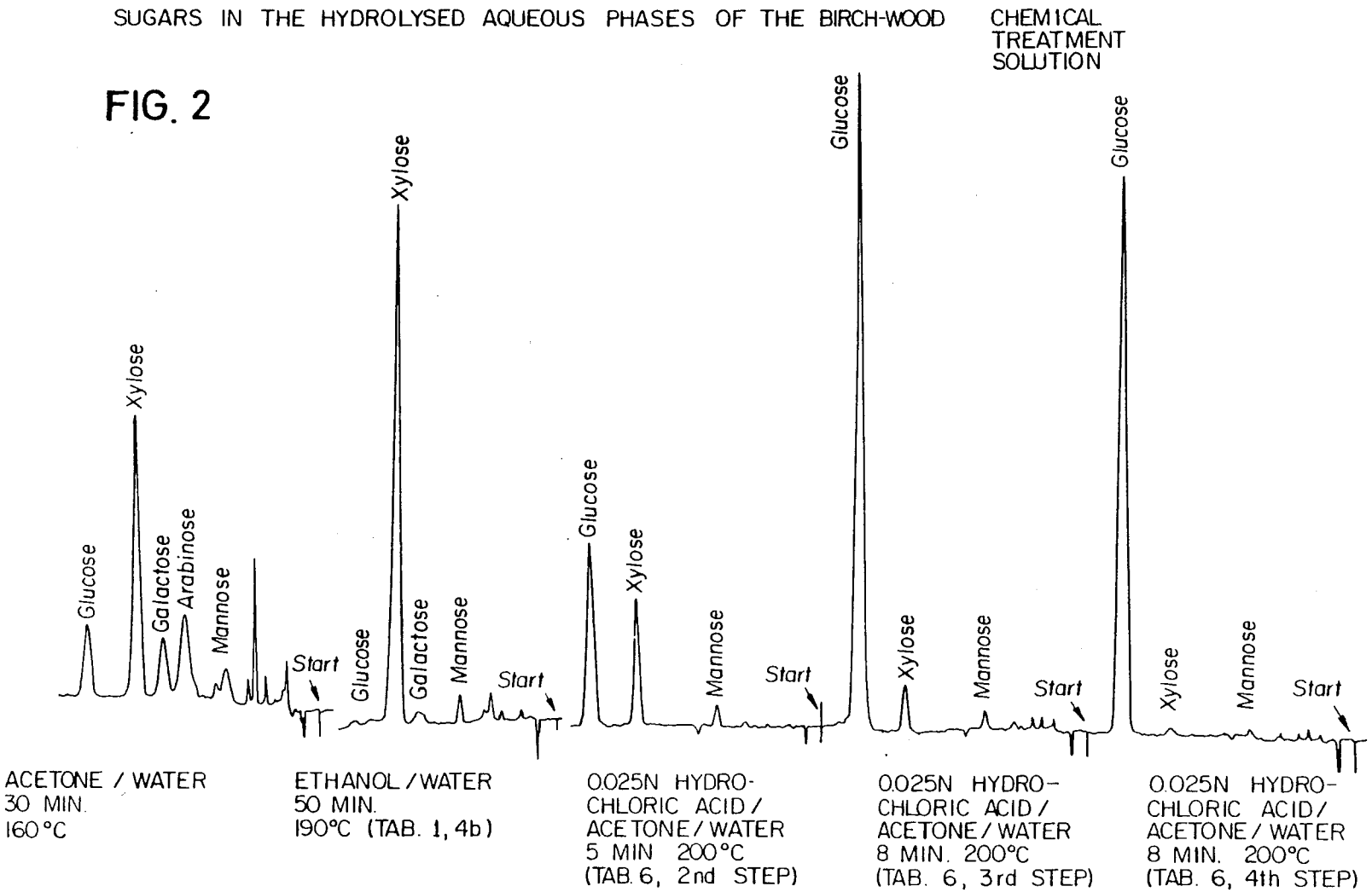
Figure 3:
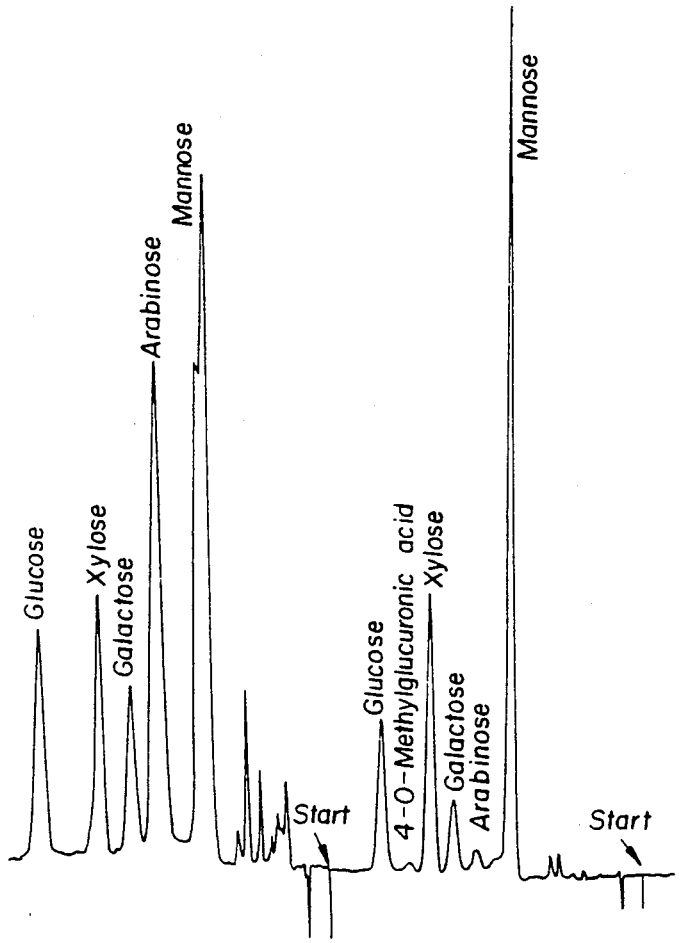
Figure 4:
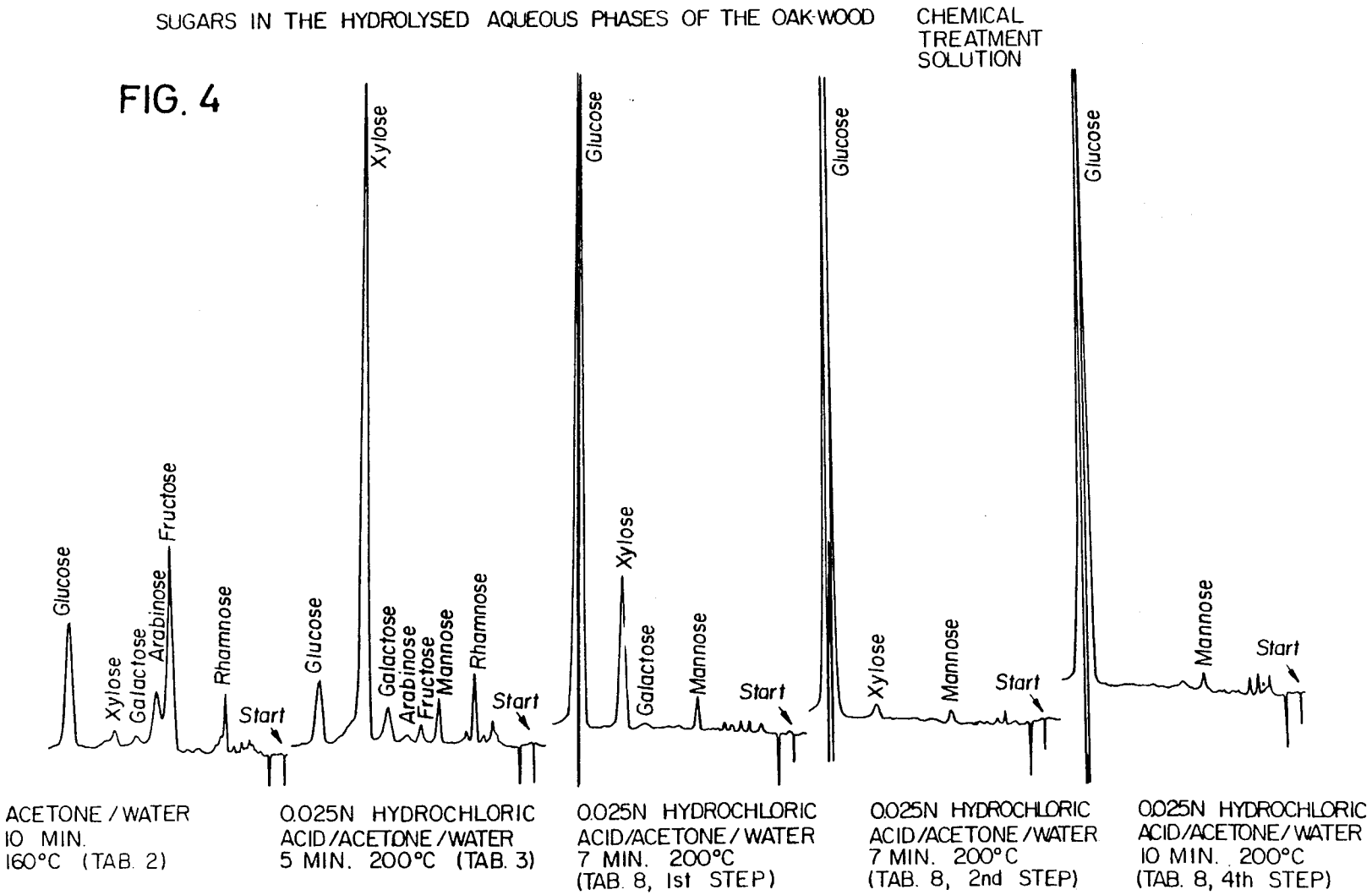
Figure 5:
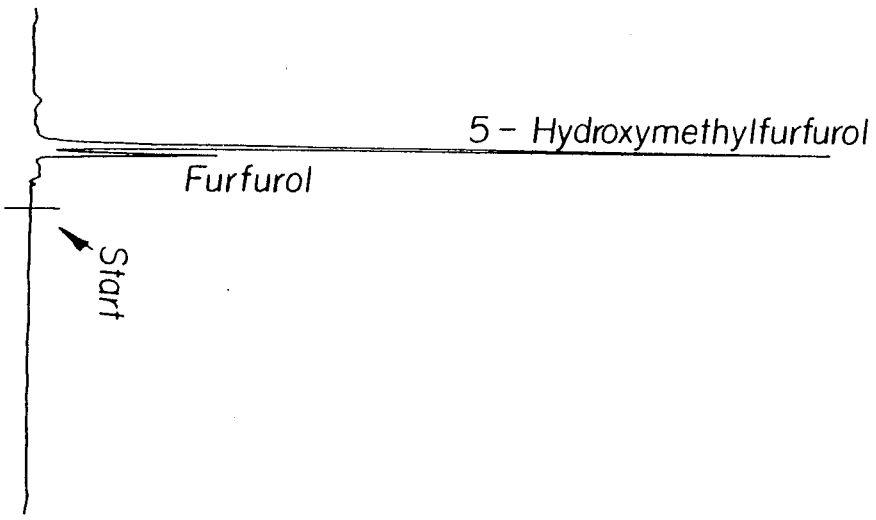

Multi-step saccharification of the fibrous material 4b of birch (chemical pre-treatment and main treatment with ethanol/water, see Example 1)

| | pre-treatment (chemical pre-/ main treatment | chemical treatment steps of the saccharification of the fibrous material 1. | 2. | 3. | 4. | 5. | total of 1st to 5th step | Total yield |
|---|---|---|---|---|---|---|---|---|
| Chemical treatment conditions | | | | | | | | |
| organic solvent | ethanol | acetone | acetone | acetone | acetone | acetone | | |
| hydrochloric acid N | 0 | 0.025 | 0.025 | 0.025 | 0.025 | 0.025 | | |
| temperature °C. | 170/190 | 200 | 200 | 200 | 200 | 200 | | |
| time min. | 25/50 | 5 | 5 | 8 | 8 | 10 | 36 | |
| Products in the aqueous phases | | | | | | | | |
| lignin | | | | | | | | |
| lignin filtered off % | −11/.3 | 2.2 | 1.2 | 2.0 | 0.5 | 0.3 | 6.2 | |
| hydrolysis residue % | 2.8/2.9 | 0.0 | 0.0 | 0.0 | 0.0 | 0.0 | 0.0 | |
| total % | 17.0 | 2.2 | 1.2 | 2.0 | 0.5 | 0.3 | 6.2 | 23.2 |
| furfurol % | 0.55 | 0.0 | 0.0 | 0.0 | 0.0 | 0.0 | 0.0 | 0.6 |
| 5-hydroxymethyl furfurol % | 0.0 | 0.08 | 0.05 | 0.29 | 0.42 | 0.71 | 1.55 | 1.6 |
| carbohydrates | | | | | | | | |
| monomeric sugars % | | 7.6 | 2.9 | 7.4 | 5.6 | 6.6 | 30.1 | |
| of this % glucose | | 32 | 61 | 92 | 97 | 98 | | |
| monomeric sugars after hydrolysis % | 20.7 | 8.2 | 3.0 | 7.7 | 6.1 | 6.9 | 31.9 | 52.6 |
| of this % glucose | | 34 | 67 | 94 | 98 | 99 | | |
| total glucose yield % | | 2.7 | 2.0 | 7.2 | 6.0 | 6.8 | 24.7 | |
| (Fibrous material )residue % | 53.0 | — | — | — | — | 13.8[2] | 13.8 | 13.8 |
| Total of products analysed % | 91.3 | | | | | 53.4(51.0)[1] | 91.7(89.3)[1] | |

[1]See footnote, Table 4

[2]This (fibrous material residue, after complete hydrolysis, yielded exclusively glucose, ie 83.1%, and 14.9% of hydrolysis, residue; ((fibrous material) residue used = 100).

TABLE 7

Single-step saccharification of fibrous material of birch (chemical pre/main treatment with acetone/water 30 min. 160° C., 40 min. 200° C.; fibrous material yield ca. 50%) under different chemical treatment conditions.

| | A. | B. | C. | D. |
|---|---|---|---|---|
| Chemical treatment conditions | | | | |
| organic solvent | acetone | acetone | acetone | acetone |
| hydrochloric acid N | 0.020 | 0.020 | 0.025 | 0.025 |
| temperature °C. | 200 | 200 | 200 | 200 |
| time min. | 13 | 20 | 13 | 20 |
| Products in aqueous phases | | | | |
| lignin | | | | |
| lignin filtered off % | 1.3 | 5.5 | 0.6 | 11.2 |
| hydrolysis residue % | 2.3 | 1.3 | 2.8 | 1.1 |
| total % | 3.6 | 6.8 | 3.4 | 12.3 |
| furfurol % | 0.28 | 0.52 | 1.58 | 1.84 |

TABLE 7-continued

Single-step saccharification of fibrous material of birch (chemical pre/main treatment with acetone/water 30 min. 160° C., 40 min. 200° C.; fibrous material yield ca. 50%) under different chemical treatment conditions.

| | A. | B. | C. | D. |
|---|---|---|---|---|
| 5-hydroxymethyl furfurol % | 2.14 | 4.72 | 3.17 | 3.83 |
| carbohydrates | | | | |
| monomeric sugars % | 14.4 | 14.1 | 16.6 | 7.5 |
| of this % glucose | 85 | 93 | 90 | 88 |
| monomeric sugars after hydrolysis % | 16.4 | 15.5 | 17.3 | 7.9 |
| of this % glucose | 89 | 94 | 93 | 93 |
| total glucose yield % | 14.6 | 14.6 | 16.1 | 7.3 |
| (fibrous material) residue % | 22.4 | 8.7 | 16.7 | 2.7 |
| Total of products analysed % | 44.8 | 36.2 | 42.2 | 28.6 |

TABLE 8

Multi-step saccharification of the fibrous materials of oak-wood, (chemical pre-treatment with acetone/water, main chemical treatment with hydrochloric acid/acetone/water; see Example 7)

| | pre-treatment (pre-/main chemical treatment) | chemical treatment steps of the saccharification of the fibrous material 1. | 2. | 3. | 4. | 5. | total of 1st to 5th step | Total yield |
|---|---|---|---|---|---|---|---|---|
| Chemical treatment conditions | | | | | | | | |
| organic solvent | acetone | acetone | acetone | acetone | acetone | acetone | | |
| hydrochloric acid N | 0/0.025 | 0.025 | 0.025 | 0.025 | 0.025 | 0.025 | | |
| temperature °C. | 160/200 | 200 | 200 | 200 | 200 | 200 | | |
| time min. | 10/5 | 7 | 7 | 9 | 10 | 12 | | |
| Products in aqueous phases | | | | | | | | |
| lignin | | | | | | | | |
| lignin, filtered off % | 2.0/13.5 | 2.0 | 1.1 | 0.1 | 0.4 | 0.0 | 3.6 | |
| hydrolysis residue % | 0.0/0.0 | 0.0 | 0.0 | 0.0 | 0.0 | 0.0 | 0.0 | |
| total % | 15.5 | 2.0 | 2.0 | 0.1 | 0.4 | 0.0 | 3.6 | 19.1 |
| furfurol % | 0.1 | 0.0 | 0.0 | 0.0 | 0.0 | 0.0 | 0.0 | 0.0 |
| 5-hydroxymethyl furfurol % | 0.0 | 0.33 | 0.14 | 0.38 | 0.70 | 0.55 | 2.1 | 2.1 |
| carbohydrates | | | | | | | | |
| monomeric sugars % | | 6.6 | 3.7 | 4.1 | 3.4 | 1.3 | 19.1 | |
| of this % glucose monomeric sugars | | 83 | 94 | 98 | 97 | 96 | | |

TABLE 8-continued

Multi-step saccharification of the fibrous materials of oak-wood, (chemical pre-treatment with acetone/water, main chemical treatment with hydrochloric acid/acetone/water; see Example 7)

| | pre-treatment (pre-/main chemical treatment) | chemical treatment steps of the saccharification of the fibrous material 1. | 2. | 3. | 4. | 5. | total of 1st to 5th step | Total yield |
|---|---|---|---|---|---|---|---|---|
| after hydrolysis % | 27.8 | 7.2 | 5.2 | 5.2 | 4.4 | 1.5 | 23.3 | 51.1 |
| of this % glucose | | 86 | 98 | 99 | 98 | 95 | | |
| total glucose yield % | | 6.2 | 5.1 | 5.1 | 4.3 | 1.4 | 22.1 | |
| (fibrous material residue) % | ca. 45 | ca. 34 | ca. 26 | — | — | 6.6 | 6.6 | 6.6 |
| total of products analysed % | ca. 88 | | | | | 35.6(33.80[1] 78.9/77.1) | | |

[1]see footnote, Table 4

We claim:

1. A process for producing xylitol from vegetable material including hemicelluloses containing a xylane component, said process comprising the steps of:

(a) pretreating said vegetable material with a first solution comprising water and at least one organic solvent selected from the group consisting of lower aliphatic alcohols and lower aliphatic ketones at a temperature of from about 100° to 190° C. and for a period of from about 4 hours to 2 minutes such that less than about 20% by weight of said xylane containing hemicelluloses in said vegetable material are hydrolyzed and go into said first solution leaving a first residue;

(b) separating said first residue from said first solution;

(c) treating said first residue with a second solution comprising approximately equal parts by volume of water and at least one organic solvent selected from the group consisting of lower aliphatic alcohols and lower aliphatic ketones at temperatures of about 120° to 220° C. and for a period of from about 6 hours to 2 minutes, such that said hemicelluloses are split to form soluble carbohydrates which go into said second solution, leaving a cellulose residue;

(d) separating said cellulose residue from said second solution;

(e) after step (d), hydrolysing any oligosaccharides and polysaccharides remaining in said second solution by addition of acid at a temperature not higher than any treatment temperature prior to step (d);

(f) after step (d), distilling said second solution under reduced pressure to separate the organic solvent from said second solution and precipitate lignin in pulverulent form;

(g) recovering xylose from said second solution, and (h) reducing the xylose to xylitol.

2. A process according to claim 1, wherein the cellulose residue separated in step (d) is hydrolysed to glucose in a mixture comprising (i) 70:30 to 30:70 parts by volume of water and acetone and (ii) at least one acid, said acid having a concentration, relative to the total volume of said mixture of from about 0.001 to about 1N, at temperatures of from about 170° to 220° C. over a period of from about 2 to 60 minutes.

3. A process according to claim 1, wherein said acid comprises from about 0.02 to about 0.025N mineral acid.

4. A process according to claim 1, wherein said acid is selected from the group consisting of nitric acid, phosphoric acid, sulfurous acid, sulfuric acid, hydrochloric acid, formic acid, acetic acid and oxalic acid.

5. A process according to claim 4, wherein said acid is sulfuric acid or hydrochloric acid.

6. A process according to claim 1, wherein in step (a) said first solution has a pH which is kept within the range of from 4 to 8.

7. A process according to claim 1, wherein in step (c) said second solution contains from 0.001 to 1N of an organic acid capable of donating a proton.

8. A process according to claim 7, wherein said organic acid is selected from the group consisting of oxalic acid and acetic acid.

9. A process according to claim 1, wherein in step (a) said first solution comprises approximately equal parts by volume of water and said organic solvent.

10. A process according to claim 1, wherein step (a) is carried out for a period of from about 2 hours to 2 minutes such that less than 5% by weight of said xylane containing hemicelluloses in said vegetable material are hydrolyzed and go into said first solution.

11. A process according to claim 1, wherein step (c) is carried out at a temperature of about 170° to 220° C. and for a period of from about 3 hours to 2 minutes.

* * * * *